US006302413B1

(12) United States Patent
Comeaux

(10) Patent No.: US 6,302,413 B1
(45) Date of Patent: Oct. 16, 2001

(54) KNEELING APPARATUS

(75) Inventor: Craig Anthony Comeaux, Church Point, LA (US)

(73) Assignee: Racatac Products, Inc., Church Point, LA (US)

( * ) Notice: Subject to any disclaimer, the term of this patent is extended or adjusted under 35 U.S.C. 154(b) by 0 days.

(21) Appl. No.: 09/307,291

(22) Filed: May 7, 1999

(51) Int. Cl.[7] ..... A01D 67/04

(52) U.S. Cl. ..... 280/32.5; 297/423.11; 297/423.16

(58) Field of Search ..... 280/32.5, 32.6, 280/87.01, 87.021, 47.38, 79.2; 297/423.11, 423.12, 423.1, 423.16; D34/23

(56) References Cited

U.S. PATENT DOCUMENTS

| | | | | |
|---|---|---|---|---|
| D. 294,546 | | 3/1988 | Opsvik . | |
| D. 303,309 | | 9/1989 | Pulda, Jr. et al. . | |
| D. 317,833 | | 7/1991 | Miller . | |
| D. 330,957 | | 11/1992 | Contrini . | |
| 2,872,966 | * | 2/1959 | Chamness | 280/32.5 |
| 3,037,570 | * | 6/1962 | Olson | 280/32.5 |
| 3,863,978 | | 2/1975 | Gillings, Jr. . | |
| 3,976,155 | * | 8/1976 | Esch | 297/423.16 |
| 4,650,249 | * | 3/1987 | Serber | 297/423.11 |
| 4,767,160 | * | 8/1988 | Mengshoel et al. | 297/423.12 |
| 4,772,071 | * | 9/1988 | Richards | 297/423.12 |
| 4,960,305 | * | 10/1990 | Opsvik | 297/423.12 |
| 5,186,519 | * | 2/1993 | Larson | 297/423.12 |
| 5,380,021 | | 1/1995 | Doherty . | |
| 5,490,716 | * | 2/1996 | Naughton | 297/423.12 |
| 5,669,669 | * | 9/1997 | Usher | 297/423.12 |
| 5,870,774 | | 2/1999 | Legenstein . | |

FOREIGN PATENT DOCUMENTS

| | | | | |
|---|---|---|---|---|
| 449588 | * | 1/1988 | (CA) | 297/423.12 |
| 2176396 | * | 12/1986 | (GB) | 297/423.12 |
| 88/00016 | * | 1/1988 | (WO) | 297/423.12 |

* cited by examiner

*Primary Examiner*—Daniel G. DePumpo
(74) *Attorney, Agent, or Firm*—William W. Stagg

(57) ABSTRACT

An apparatus for providing seating and buttock and lower back support to a kneeling worker. The apparatus is comprised of a tubular frame, a plurality of support casters, an adjustable seat and seat pedestal, and a pair of padded knee supports. The apparatus has at least one rear support caster mounted rearward of the seat for supporting the frame and worker when the worker is sitting on the seat.

8 Claims, 3 Drawing Sheets

KNEELING APPARATUS

FIELD OF INVENTION

The present invention generally relates to the field of kneeling devices, more particularly, relates to an improved kneeling apparatus that provides ease of movement and allows a worker to work comfortably on his knees with sifting support to the worker and allows the worker to change from a kneeling to a sifting position as desired.

BACKGROUND OF THE INVENTION

Workers, such as mechanics, brick layers, tile setters, painters, and welders, are often required to perform their tasks from a kneeling position. Maintaining the kneeling position as well as moving to and from the kneeling position typically places a great deal of strain on the worker. The worker must make many transition movements from kneeling to sitting to standing in a typical workday. The body stress associated with the worker's kneeling position and with the transition to and from the kneeling position contributes greatly to the workers fatigue and increases the likelihood of work related injuries, particularly injuries to the worker's knees and lower back.

A number of kneeling apparatus have been proposed over the years to assist the kneeling working and in an effort to alleviate the stress and fatigue associated with the kneeling position of the worker. Among those is U.S. Pat. No. 5, 870, 774 to Legenstein for strap-on wheeled knee pads for workers who must work on their knees. The knee pads have a hard shell knee pad supported on a plurality of swiveling casters. Another kneeling aid was disclosed in U.S. Pat. No. Des. 294,546 to Opsvik for an ornamental design for a combined seat and kneeler. A cushioned seat supported on a pedestal having three support points is disclosed. One of the support points is a wheel positioned toward the rear of the seat.

Another kneeling apparatus is that shown in U.S. Pat. No. Des. 317,833 to Miller et al. The Miller et al. patent disclosed an ornamental design for a kneeler having a rectangular knee pads for supporting a workers knees and vertically positioned combination handles and tool boxes. Still another device is that shown in U.S. Pat. No. 5,380,021 to Doherty for a mobile knee support apparatus. The Doherty apparatus discloses a pair of horseshoe shaped frames supported on casters. A sling of sheet material is spread on each frame for supporting the knees. The frames are connected by a flexible connector or a rigid sheet.

Still another device is U.S. Pat. No. Des. 330,957 for a combined creeper and tool caddy. The design discloses a wheeled creeper having knee supports. Another kneeling device is that shown in U.S. Pat. No. 3,863,978 to Gillings, Jr. for a body supporting structure for supporting the user in a combined kneeling and sifting position.

None of the devices allow the worker to have sitting support and knee support as he moves about on his knees while working. Further, none of these devices allow the worker to have sifting support during the transition from a kneeling to a sifting position while allowing free and easily controlled mobility from a kneeling position. Finally, none of these devices allow the worker to maintain a sifting position or a kneeling position as the worker may desire.

Considering the foregoing, a need exists for an improved kneeing apparatus that provides sifting support to the user's buttocks and lower back, facilitates the worker's movements while in a kneeling position and allows the worker to make an easy transition from a kneeling position to a sitting position.

SUMMARY OF THE INVENTION

The applicant's improved kneeling apparatus is designed to satisfy the aforementioned needs. The apparatus consists of a light, tubular frame supported by a plurality of casters. Supported on either side of the frame is a pair of padded knee shells to cushion and support each knee of the worker. A bicycle-type seat for support the buttocks of a worker is attached to the rear of the frame by a vertical seat pedestal. The seat and pedestal includes means to allow for vertical, horizontal and pivotal adjustment of the seat so that the seat may be pivoted or tilted to a desired position, moved forward or rearward along the centerline of the frame, and placed upward or downward as desired by the worker. A distinctive feature of the invention is an additional support wheel mounted to the frame and positioned rearward of the seat and seat pedestal, at a point behind the frame, to support the frame when the worker transitions from a kneeling position to a sitting position.

The apparatus is light and easily movable by the worker. The padded knee shell, in combination with the adjustable seat, provides a cushioned support for a worker's knees, whether the worker working from one knee or both knees, and support to the workers buttocks and lower back. The rear-mounted wheel allows the apparatus to be used a wheeled stool should the worker desire to work in a sitting position.

In the preferred embodiment, the frame is trapezoidal shaped and made of tubular aluminum tubing though other metals and other frame configurations, including even a solid plate-like frame, might be utilized. The rearward end of the frame supports a vertical pedestal to which is adjustably mounted a bicycle seat. The seat and seat pedestal is detachable from the frame to allow for easy transportation and storage of the apparatus.

In the preferred embodiment, the frame is supported on a plurality of metal frame casters, each having hard rubber wheels. The frame casters are mounted below the frame, forward of the seat location, to support the body weight of the worker when the worker is in a kneeling position. The frame also has at least one caster having hard rubber wheels, mounted rearward of the support seat to provided support to the frame and the worker, in conjunction with the frame casters, when the worker is in a sitting position on the seat.

The preferred embodiment employs a pair of knee supports mounted to the frame. The knee supports or comprised of rigid hard plastic shells having a layer, or layers, of foam padding for cushioning the worker's knees. The knee supports are positioned to allow the worker to kneel on either one knee or both knees and still control the rolling movement of the apparatus.

It is therefore an object of this invention to provide a wheeled kneeling apparatus that provides support for the worker's knees and seat while the worker is kneeling.

It is a further object of the invention to provide a wheeled kneeling apparatus that will allow the worker to work from either one knee or both knees and still support the buttocks and seat of the worker.

It is a further object of the invention to provide a wheeled kneeing apparatus to support the buttock and seat of the worker while he transitions from a kneeling to a sitting position.

It is still a further object of the invention to provide a wheeled kneeling apparatus in combination with a seat, to allow the worker to work from a kneeling or a sitting position as desired. Other objects will be apparent from the description contained herein.

DESCRIPTION OF THE PREFERRED EMBODIMENTS

Figure 1:
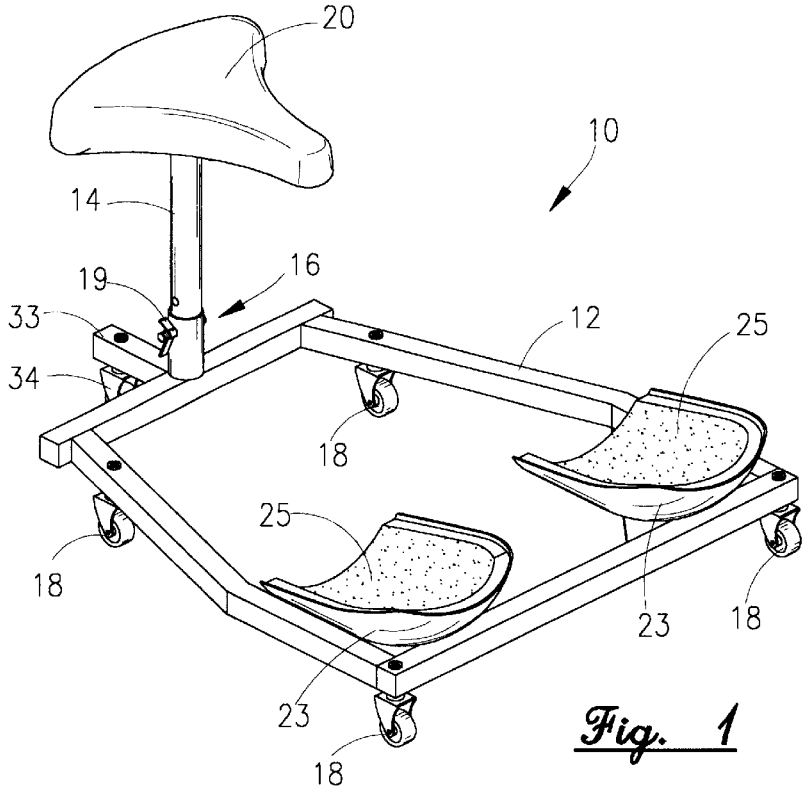
FIG. 1 is a perspective view of the kneeling apparatus of the present invention.
Figure 2:
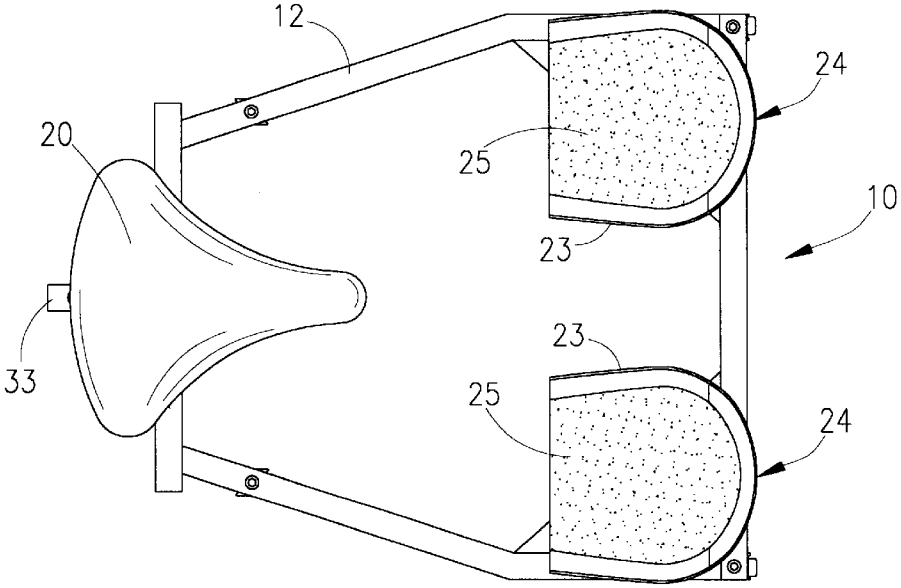
FIG. 2 is a top view of the kneeling apparatus of FIG. 1.

Referring now to the drawings, and more particularly to FIG. 1, there is shown a perspective view of kneeling apparatus (10) of the present invention. The apparatus (10) is comprised of a trapezoidal shaped tubular frame (12). The frame (12) is made of aluminum tubing though other metals and materials and other configurations, including a plate-like frame, could be utilized.

Figure 3:
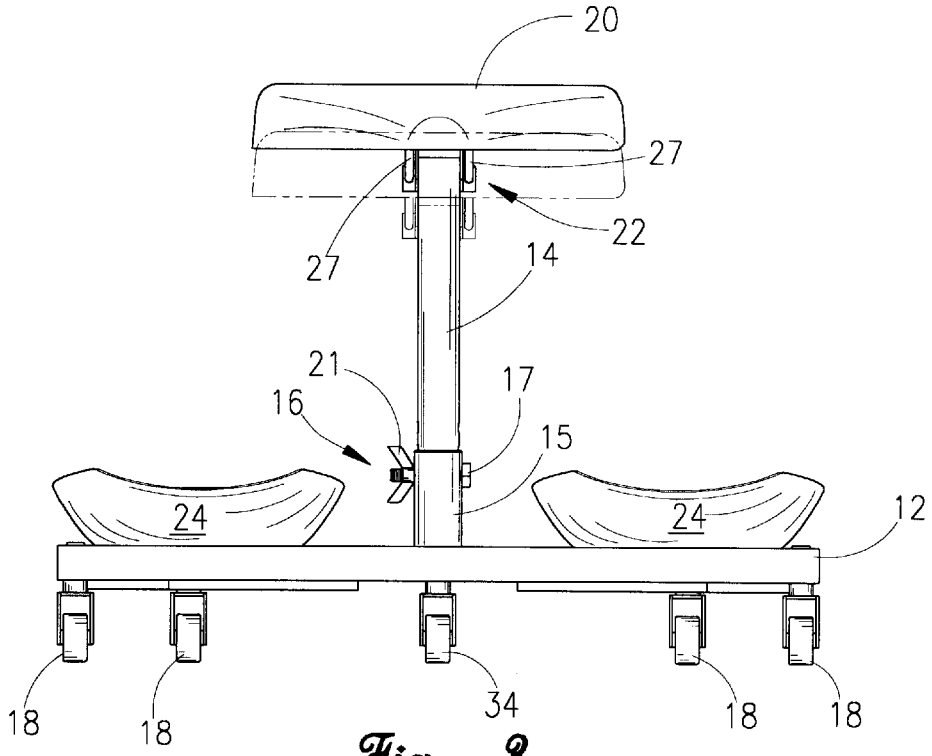
FIG. 3 is a front view of the kneeling apparatus of FIG. 1.
Figure 4:
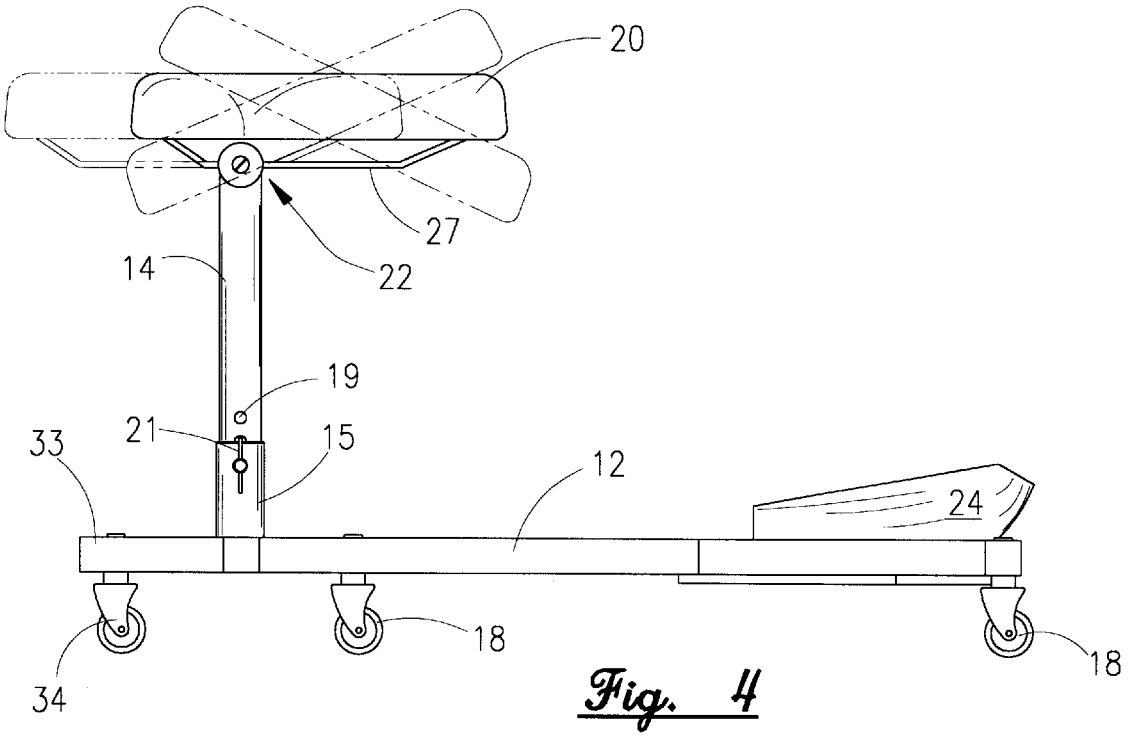
FIG. 4 is a side view of the kneeling apparatus of FIG. 1.
Figure 5:
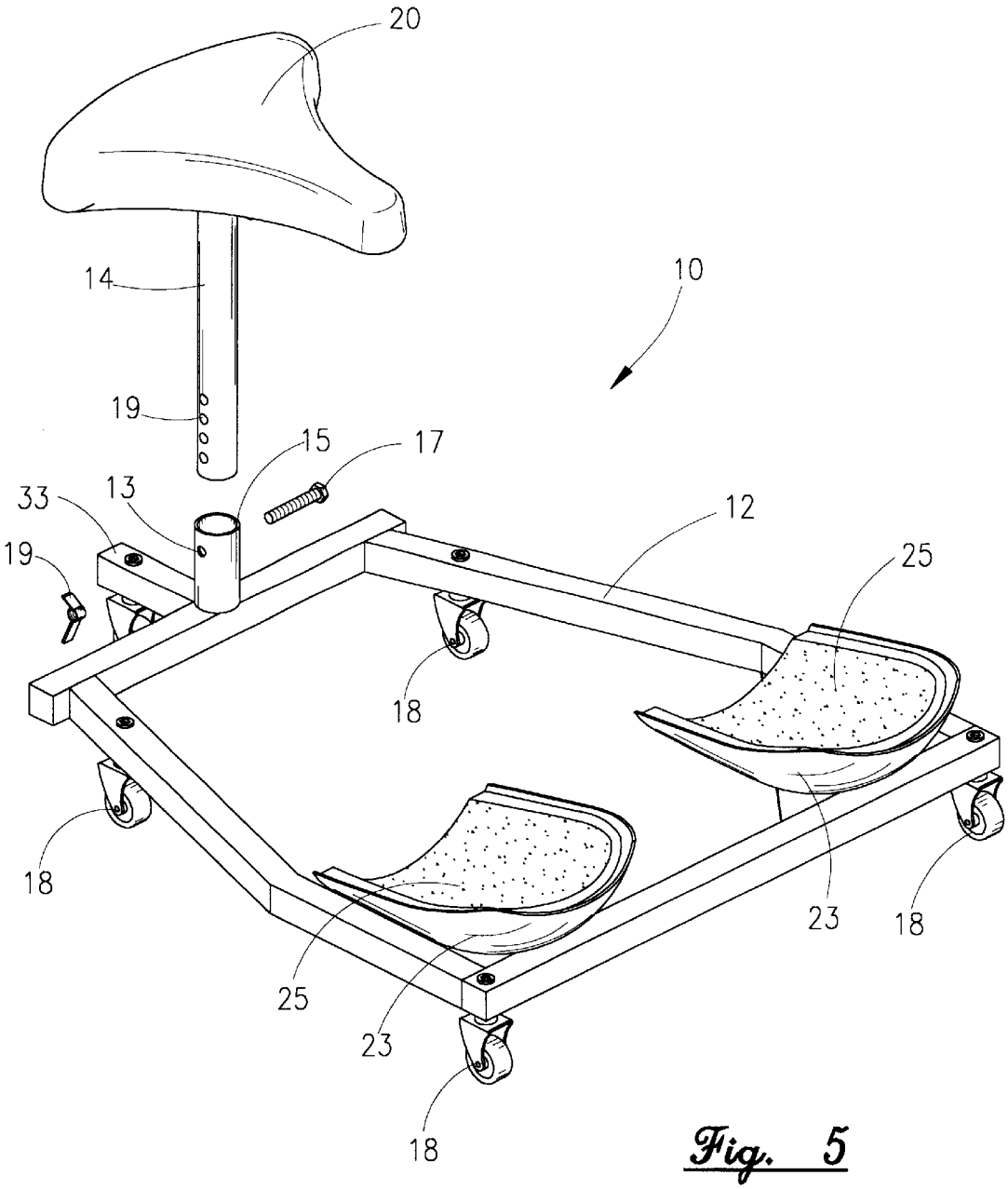
FIG. 5 is breakaway view of the kneeling apparatus of FIG. 1.

As shown in FIG. 3 and FIG. 4, the frame (12) is disposed in a substantially horizontal plane. Mounted to the frame (12), at its rearward end, is a vertically positioned seat pedestal (14). The seat pedestal (14) is detachably mounted to the frame (12) and its height is vertically adjustable by means of a seat-pedestal detaching and adjusting means (16). In the preferred embodiment, as shown in FIGS. 3 and 5, the detaching and adjusting means (16) is comprised of a frame seat socket (15) for receiving the seat pedestal (14). The pedestal (14) is held in place by a pedestal pin (17) that engages holes (13) in the seat socket (15) and holes (19) in the seat pedestal (14). The pedestal pin is secured in place by wing-nut (21). Adjustably mounted to the seat pedestal (14) is a bicycle-seat (20). As shown in FIG. 4, the seat (20) is positioned on the seat pedestal (14) to maintain the seat (20) at the rearward end of the frame (12). The height of the pedestal (14), and hence the position of the seat (20) above the frame (12), is determined by the selection of a desired hole (19) for inserting the pin (17).

As shown in FIG. 4, the seat (20) includes a seat rail (27) that allows the seat (20) to be mounted on the pedestal (14) by means of a pivotally adjustable seat support (22). The seat rail (27) and seat support (22) allows the seat (20) to pivot or tilt upward or downward as desired. The adjustable seat support (22), in combination with the seat rail (27), allows the seat (20) to be positioned or adjusted forward or rearward by attaching the seat support (22) to a desired point on the rail (27). In this manner the seat position can be adapted to the physique of a particular user and fixed as desired. The seat support (22) in the preferred embodiment is adjustably fixed by a nut and bolt-like combination but other adjustable means may also be utilized.

Mounted forward of the seat pedestal (14) and the seat (20), on the forward end of the frame (12), is a pair of knee supports (24). In the preferred embodiment, each knee support (24) is comprised of a hard rigid plastic shell (23) that is overlaid by a plurality of padded cushions (25). The cushions or comprised of layers of fabric covered foam rubber. Other suitable materials may also be utilized for both the shell (23) and the cushions (25).

As shown in the drawings, the frame (12) is supported on a plurality of hard rubber-wheeled frame casters (18). In the preferred embodiment four frame casters (18) are utilized. The frame casters (18) are positioned evenly about the frame (12) forward of the seat pedestal (14). Typically there are two forward casters (18) and two rearward casters (18) to evenly distribute the weight of the worker when the worker's knees are placed in the knee supports (24) while the worker is kneeling on both knees.

Mounted to the frame (12), rearward of the seat pedestal (14), is a rear caster support bar (33). The rear caster support bar supports at least one hard rubber-wheeled caster (34) in a position rearward of the seat pedestal (14). As can be seen in FIG. 4, the rearwardly positioned caster (34) is located to provide support for the weight of a worker when the worker is sitting on the seat (20). The rearwardly positioned caster (34) works in conjunction with the frame casters (18), particularly the rearwardly located frame casters (18), so that the apparatus serves as a rollably positionable stool when the worker is in a seated position on the seat (20).

The apparatus (10), when configured as shown in the drawings, allows the worker to work on one or both knees or in a sitting position. The apparatus (10) rolls easily on the hard rubber-wheeled casters (18) and (34). In the typical kneeling mode of use, the worker is in a kneeling position with both knees in the knee supports (24) and with his buttocks braced by the seat (20) for support. The weight of the kneeling worker is then distributed principally upon the frame casters (18) for support.

In the typical sitting mode of use, the worker is seated on the seat (20) with the worker's knees out of the knee supports (24). In this case, the weight of the worker is distributed principally upon the rearwardly positioned caster (34) and the rearwardly positioned frame casters (18). The casters (34) and (18) allow for support of the worker while the worker is in a sitting position and prevent tipping of the apparatus (10).

The position of the seat (20) can be adjusted to pivot or tilt and moved forward or rearward by means of pivot support (22) and seat rail (27). The height of the seat (20) in relation to the frame (12) may also be adjusted by the detaching and adjusting means (16) to suit the worker. In this manner the worker may adjust the seat to accommodate the workers individual physique whether the worker is in a kneeling or a sitting position.

It is thought that the improved kneeling apparatus of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. An apparatus for supporting a kneeling worker comprising:

(a) a tubular frame, said frame being disposed in a substantially horizontal plane and having upper and lower surfaces and forward and rearward ends;

(b) a plurality of forward support casters mounted to said lower surface of said frame between said forward end and said rearward end of said frame;

(c) a substantially vertically extending seat pedestal, said seat pedestal having a base end and a cap end, said base end of said seat pedestal being mounted to said upper surface of said frame at a point on said frame substantially at said rearward end of said frame;

(d) a seat mounted to said pedestal at a point on said pedestal substantially at said cap end of said pedestal;

(e) a pair of knee supports mounted to said upper surface of said frame between said forward end and said rearward end of said frame;

(f) a rear support bar, extending rearwardly from said rearward end of said frame behind said seat, said support bar having an upper and lower surface; and (g) at least one rear support caster mounted to said lower surface of said support bar for supporting said frame.

2. The apparatus as recited in claim 1, wherein said seat is a bicycle seat supported on a seat pedestal mounted to said rearward end of said frame.

3. The apparatus as recited in claim 2, wherein said seat pedestal includes means for adjusting said seat vertically upward and downward from said upper surface of said frame, means for pivotally adjusting said seat, and means for positioning said seat backward and forward with respect to said forward end and said rearward end of said frame.

4. The apparatus as recited in claim 3, wherein said knee supports are comprised of a padded hard plastic shell.

5. An improved kneeling apparatus for supporting a worker when said worker is working in a kneeling position comprising:

(a) a tubular frame, said frame being disposed in a substantially horizontal plane and having upper and lower surfaces and forward and rearward ends;

(b) at least two forward support casters, said forward support casters being mounted to said lower surface of said frame and being positioned substantially at said forward end of said frame;

(c) a vertically extending seat pedestal;

(d) a means for adjustably mounting said seat pedestal to said upper surface of said frame at a position substantially at said rearward end of said frame;

(e) at least one rear support caster mounted to said lower surface of said frame at a position rearward of said seat pedestal;

(f) a seat mounted to said seat pedestal; and (g) a pair of cushioned knee supports mounted to said upper surface of said frame, said knee supports being contoured for receiving the knees of a worker, said knee supports being positioned on said frame at a location with respect to said seat pedestal and said seat so as to allow said worker to position himself on said frame with said knees of said worker in said knee supports in a manner whereby support is provided to said knees of said worker by said knee supports and to the buttocks of said worker by said seat when said worker is in a kneeling position.

6. The apparatus as recited in claim 5, wherein said seat is pivotally mounted so as to provide adjustable support to said buttocks of said worker.

7. The apparatus as recited in claim 5, wherein said seat has means for detaching said seat from said pedestal and said pedestal has means for detaching said pedestal from said frame.

8. The apparatus as recited in claim 6, further comprising means for selectively positioning said seat horizontally, forward or rearward, with respect to said frame.

* * * * *